US007600835B2

(12) United States Patent
Moriyama et al.

(10) Patent No.: US 7,600,835 B2
(45) Date of Patent: Oct. 13, 2009

(54) INK TANK, PRINTING APPARATUS AND MONITORING SYSTEM FOR USED-INK AMOUNT

(75) Inventors: Jiro Moriyama, Kanagawa (JP); Norihiro Kawatoko, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 91 days.

(21) Appl. No.: 10/911,608

(22) Filed: Aug. 5, 2004

(65) Prior Publication Data

US 2005/0046650 A1 Mar. 3, 2005

(30) Foreign Application Priority Data

Aug. 5, 2003 (JP) ..... 2003-286974

(51) Int. Cl.
*B41J 2/195* (2006.01)
*B41J 2/175* (2006.01)

(52) U.S. Cl. ..... 347/7; 347/6; 347/86

(58) Field of Classification Search ..... 347/7
See application file for complete search history.

(56) References Cited

U.S. PATENT DOCUMENTS 5,519,418 A 5/1996 Nishikawa et al.
5,625,384 A 4/1997 Numata et al.
6,024,429 A * 2/2000 Coffy et al. ..... 347/7
6,137,503 A 10/2000 Hashimoto et al.
6,155,664 A * 12/2000 Cook ..... 347/7
6,634,738 B1 * 10/2003 Shinada et al. ..... 347/86
6,827,417 B2 * 12/2004 Seino ..... 347/19
6,913,336 B2 * 7/2005 Hara ..... 347/7
6,969,137 B2 * 11/2005 Maeda ..... 347/7
7,344,214 B2 * 3/2008 Chan ..... 347/7

FOREIGN PATENT DOCUMENTS

| | | |
|---|---|---|
| EP | 0 593 282 | 4/1994 |
| JP | 6-126981 | 5/1994 |
| JP | 10-202902 | 8/1998 |
| JP | 2002-86709 | 3/2002 |

* cited by examiner

*Primary Examiner*—Matthew Luu
*Assistant Examiner*—Shelby Fidler
(74) *Attorney, Agent, or Firm*—Fitzpatrick, Cella, Harper & Scinto

(57) ABSTRACT

Information can be provided for determining the current states of an ink tank and a printing apparatus within a range exceeding a standard amount of the ink in the ink tank to be controlled as an amount of the ink usable by the printing apparatus. For this purpose, information concerning an amount of the ink used exceeding the standard amount of the ink being controlled as an amount of the ink usable by the printing apparatus is stored in a memory portion of the ink tank.

1 Claim, 5 Drawing Sheets

INK TANK, PRINTING APPARATUS AND MONITORING SYSTEM FOR USED-INK AMOUNT

BACKGROUND OF THE INVENTION

1. Field of the Invention

The present invention relates to an ink tank provided with a memory, a printing apparatus to use the ink tank and a used amount of ink monitoring system.

2. Description of the Related Art

Recently, a technology relating to the coloring (multi-coloring) of the image has so progressed that a printing apparatus using inks of a plurality of colors and a multi-color input apparatus is increasing in the market. Especially, an ink-jet printing apparatus, for its advantages such as low noise, low manufacturing cost, low running cost, adaptability for greater compactness, has come to be used widely as a printing apparatus or a copying machine or the like.

Conventionally, the kinds of ink tanks designed to be capable of having information about a remaining amount of ink in a replaceable (or interchangeable) ink tank have been proposed (see Japanese Patent Application Laid-open Nos. 2002-86709 and 6-126981 (1994)). More particularly, each of such ink tanks is provided with a memory element capable of storing the information about the remaining amount of the ink in the tank. Further, both Japanese Patent Application Laid-open Nos. 2002-86709 and 6-126981 (1994) respectively disclose a function for enabling the user of the printing apparatus to obtain an information about the remaining amount of the ink or the presence or absence of the remaining ink.

The printing apparatus, having the construction as is described above, is provided with a function for measuring the remaining amount of the ink in the ink tank in a range of the amount of usable ink normally taken from the ink tank (hereinafter referred to as "standard amount of the ink"). With such a type of printing apparatus, when the ink is used exceeding the range of the standard amount of the ink, the remaining amount of the ink is not measured and such remaining amount of the ink is not stored in the memory element of the ink tank, and these measuring and storing are not necessary.

In practice, however, there occurs a variance in the remaining amount of the ink in the tank owing to a variance resulting from the manufacturing process of the ink tank or a variance resulting from the operating condition of the printing apparatus, and so there is the possibility that the ink actually remains in the tank even when the remaining amount of the ink detected by the printing apparatus is "0". In the case of the printing apparatus such as one described above, therefore, it actually can occur that the ink remaining in the tank is left unused where the printing apparatus is designed so that printing operation is discontinued when the remaining amount of the ink in the tank is detected as being "0" by the printing apparatus.

Further, if the user refills the ink tank, in which the amount of remaining ink came to decrease, with the ink purchased from the supplier other than the original supplier, the printing apparatus will become unable to measure the actually used amount of the ink from the amount of the ink remaining in the tank.

SUMMARY OF THE INVENTION

An object of the present invention is to provide an ink tank, a printing apparatus and a monitoring system for used-ink amount, which are respectively designed for being capable of providing the information telling the current states of the ink tank and the printing apparatus within a range exceeding the standard amount of the ink to be controlled as being the usable amount of the ink by the printing apparatus.

In the first aspect of the present invention, there is provided an ink tank, for containing an ink to be supplied to a printing apparatus, comprising storing means for storing information concerning a remaining amount of the ink; wherein the storing means is capable of storing the information concerning the remaining amount of the ink within a range of an amount of the ink including a standard amount of the ink and an extra amount of the ink, the standard amount of the ink is controlled by the printing apparatus as a usable amount of the ink, and the extra amount of the ink is controlled by the printing apparatus as an amount of the ink usable when the printing apparatus is operated to use more than the standard amount of the ink.

In the second aspect of the present invention, there is provided a printing apparatus for performing a printing operation by using an ink to be supplied from the ink tank of the first aspect of the present invention, wherein the printing apparatus comprises a means for enabling the storing means to store the information concerning the remaining amount of the ink within a range including the sum of the standard amount of the ink and the extra amount of the ink.

In the third aspect of the present invention, there is provided a monitoring system for used-ink amount of an ink tank of the first aspect of the present invention, comprising a means for displaying monitoring information about a used amount of the ink in the ink tank on the basis of the information concerning the remaining amount of the ink obtained from the storing means of the ink tank.

The present invention enables the memory of the ink tank to store the information about the remaining amount of the ink in the range exceeding the standard amount of the ink to be controlled as being the usable amount of ink by the printing apparatus so that the current state of the ink tank and the operating condition of the printing apparatus can be observed with higher accuracy.

As a consequence, the used amount of the ink can be controlled including the variances resulting from the manufacturing process of the ink tank and the using condition the ink tank thereby to minimize the unused ink remaining in the tank from being wasted. Further, even in a case such that the user of the printing apparatus added the ink purchased from the supplier other than the original supplier to the ink tank, the amount of the ink used from such refilled ink can also be stored in the memory, so that the such data about the amount of the ink can also be utilized for analyzing a cause of the trouble.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The various embodiments of the present invention will be described hereunder referring to the pertinent drawings.

The First Embodiment

Figure 1:
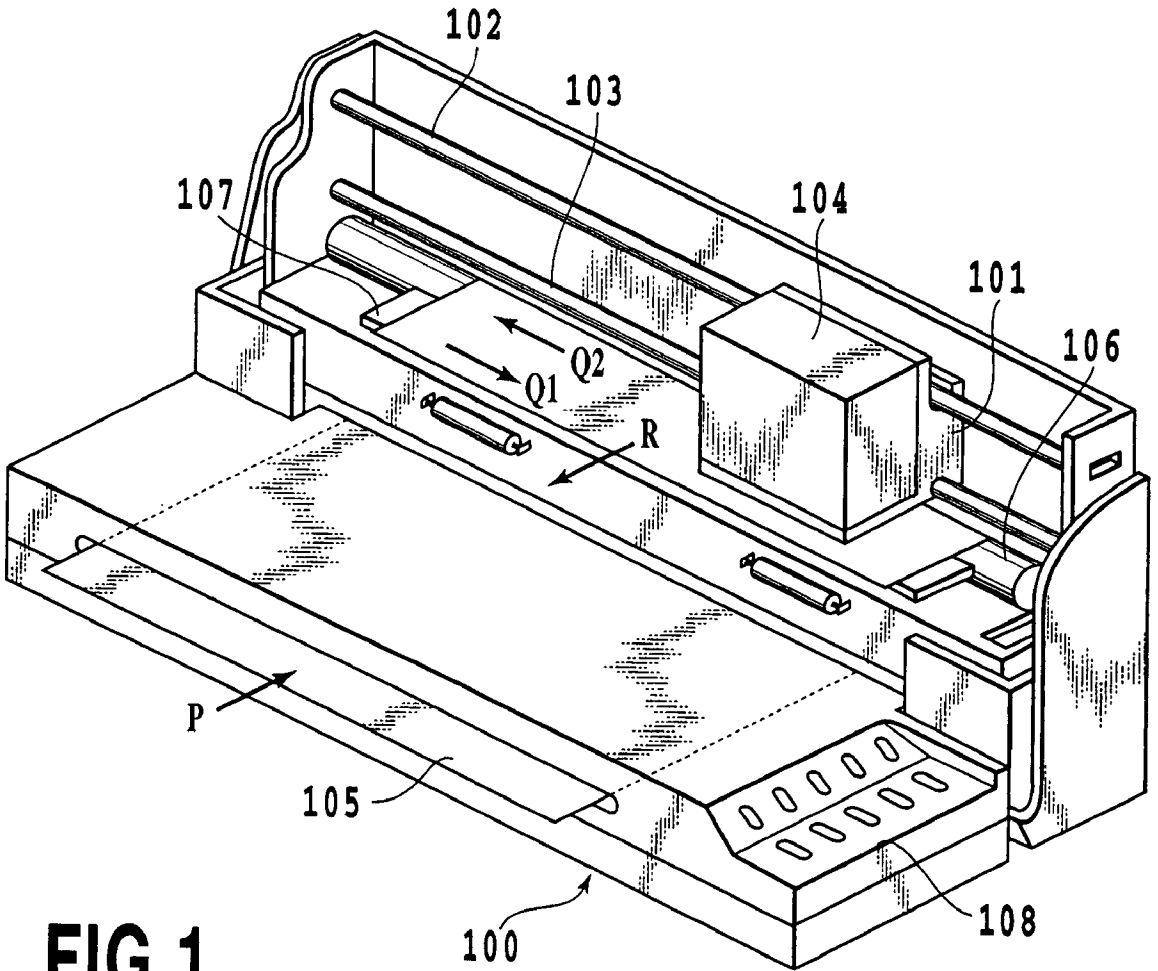
FIG. 1 is a perspective view showing the principal components of the printing apparatus to which the present invention can be applied.

FIG. 1 is a perspective view schematically showing the composition of an ink-jet printing apparatus to which the present invention can be applied.

A printing medium 105, which has been inserted into a paper sheet feed position of the printing apparatus 100, is transferred in the direction of arrow P by a feed roller 106 and then transferred to the adverse direction indicated by arrow R (sub-scanning direction) to be transferred to a printable area of a printing head 104. A platen 107 is provided under the printing medium 105 in the printable area. A carriage 101, mounted with the printing head 104, is made to travel by being guided two guiding shafts 102 and 103 in the directions of arrows Q1 and Q2 (main scanning direction) along the axial directions of the guide shafts. The carriage 101 is reciprocated in the directions of the arrows Q1 and Q2, by a driving force of a stepping motor (not shown), within a scanning area including a printing area over the printing medium 105. The printing head 104 prints an image of a predetermined width on the printing medium 105 by moving in the main scanning direction together with the carriage 101 while ejecting ink in a fashion described later. Upon completion of one main scanning, the printing medium 105 is transferred for a predetermined distance (sub-scanning) to be ready for the subsequent main scanning. A desired image can be printed on the printing area of the printing medium 105 by repeating such main scanning and the sub-scanning alternately.

Reference numeral 108 denotes a combination portion comprising a switch portion and a display portion; the switch portion is used for the on/off operation of the power source of the printing apparatus 100 and for the setting of various printing modes, while the display portion is used for displaying the various states of the printing apparatus 100.

As in FIG. 1, the printing head 104, mountable with the carriage 101, comprises ejecting ports for ejecting ink and an ink tank for containing the ink. The printing head 104 can be an ink-jet printing head incorporating an electrothermal conversion element into the ink passage thereof communicating with the ejecting ports. In such a printing head, the ink is made to foam by using the heat to be generated by the electrothermal conversion element so that ink dots are ejected from the ejecting ports by utilizing the foaming energy. The printing head 104 to be employed may be of various ink-jet types incorporating various devices including the piezoelectric element and the like besides the electrothermal conversion element. The printing head 104 is mounted on the carriage 101 in a fashion that the ink can be ejected from the ejecting ports against the printing medium 105 coming thereunder.

The printing head 104 is capable of making desired print by using the inks of 4 different colors, namely Y (Yellow), M (Magenta), C (Cyan) and Bk (Black). In the case of the present embodiment, 128 ejecting ports are provided for each of the Y ink, M ink and C, while 320 ejecting ports are provided for the Bk ink, such ejecting ports for each color ink being pitched at 600 dpi (dot/inch) or at about 42 microns, respectively. The driving frequency for the printing head 104 is 15 kHz for enabling the print to be made at the printing density of 600 dpi in the main scanning direction. Hence, the traveling speed of the carriage 101 during the printing operation is 25 i/s (inch/second).

Figure 2A:
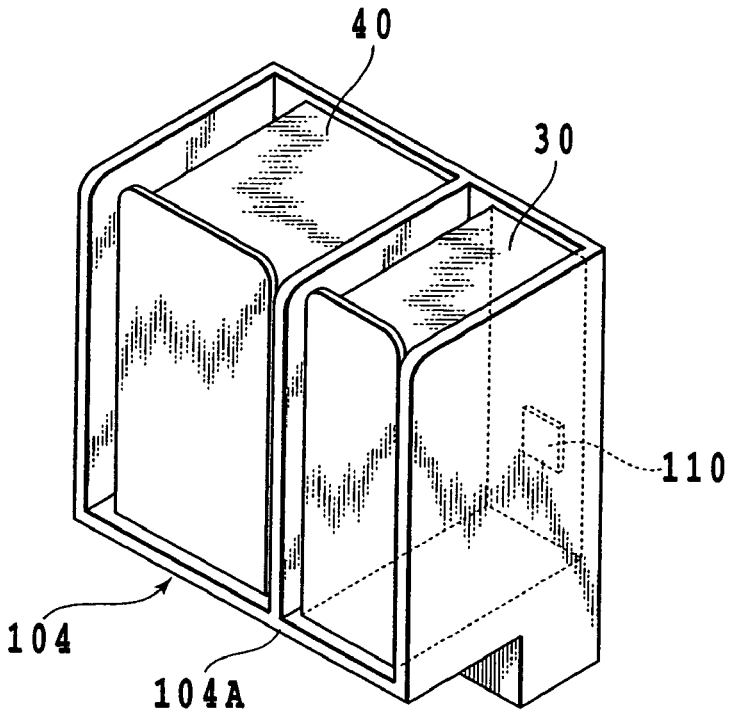
FIG. 2A is a perspective view of the printing head shown in FIG. 1.
Figure 2B:
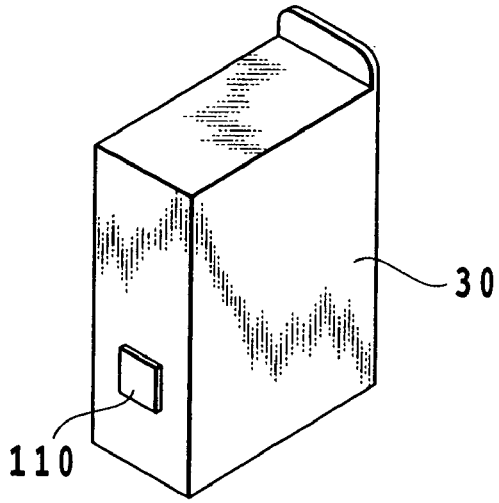
FIG. 2B is a perspective view from the opposite side of the Bk tank shown in FIG. 2A.

FIG. 2A and FIG. 2B illustrate a composition example of the printing head 104 respectively.

A bottom 104A of the printing head 104 is formed with the ink ejecting portion having the ejecting ports for ejecting ink. The ink ejecting portion and the ink tank are designed for being separable from each other, while a Bk tank 30 for containing the Bk ink and a color tank 40 for containing the color inks (Y, M and C inks) can be installed independently from each other. Each of the tank 30 and the tank 40 is provided with a memory portion 110 (In FIG. 2A, the memory portion 110 on the color tank 40 is not shown). FIG. 2B is a perspective view of the Bk tank 30 viewed from the direction opposite to the direction in FIG. 2A, the Bk tank 30 being provided with the memory portion 110. The memory portion 110 is electrically connected with the printing apparatus 100 through an electrode of the printing head 104. To the memory portion 110 of the Bk tank 30, an information about a remaining amount of the Bk ink is rewritably memorized, while to the memory portion 110 of the color ink tank 40, an information about remaining amounts of the C ink, M ink and Y is rewritably memorized.

In the case of the present embodiment, the printing head 104 is designed to be separable from the tanks 30 and 40, while the tanks 30 and 40 are provided with semiconductor chips as being the memory portions 110. The memory portion 110 stores the information on the remaining amounts of the inks in the tank 30 and the tank 40 respectively by the unit of percentage. In the initial stage, the memory portion 110 stores 100% as the information on the remaining amounts of the inks. Hence, as the amounts of the various inks in the tank 30 and the tank 40 decrease respectively as the result of the printing operation, the printing apparatus 100, as described later in detail, will decrease the remaining amounts of the inks (%) stored in the memory portions 110. The memory 110 is electrically connected with the printing apparatus 100 through the electrode terminal of the printing head 104.

The printing apparatus 100 measures the amount of each ink used for the printing and deducts such used amount of the ink from the remaining amount of the ink in the tank stored with the memory portion 110 to determine the amounts of the inks remaining in the tanks 30 and 40 respectively, thereby updating the remaining amounts of the inks stored with the memory portions 110. The printing apparatus 100 is capable of measuring all the amounts of the inks used such as those used for the printing of the image, the amount of the ink discharged for a restoring operation of the printing head 104 or the like, which are supplied to the outside from the tanks 30 and 40. The restoring operation for the printing head 104 is needed for always keeping the ejecting condition of the printing head 104 at a satisfactory level; in order to do fulfill such a requirement, for instance, the ink, which does not contribute to image forming, is ejected from the ejecting ports of the printing head 104 (preparatory ejection), discharged by suction (restoring operation by suction), or discharged by applying the pressure (restoring operation by pressure).

Figure 3:
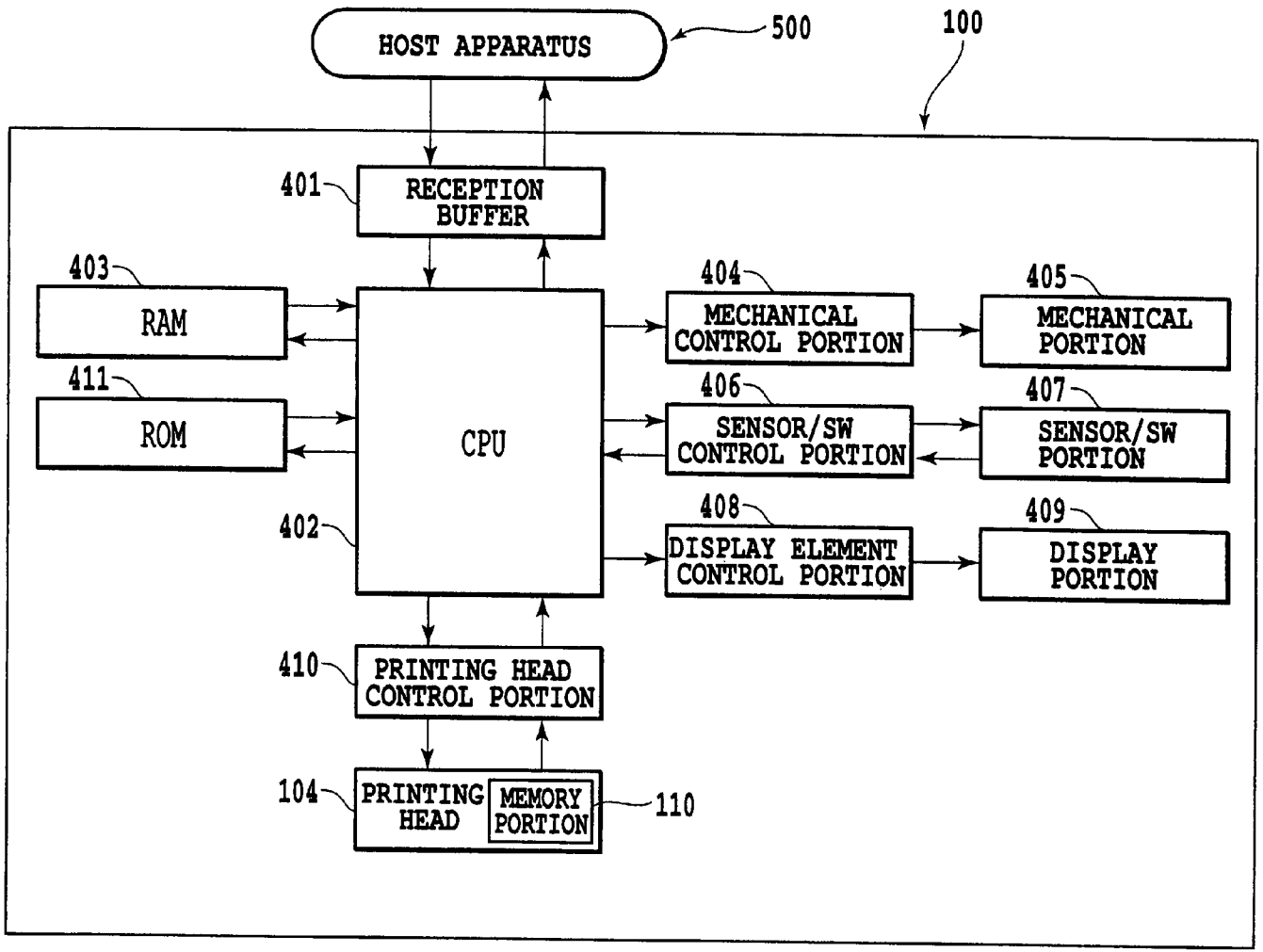
FIG. 3 is a block diagram showing the composition of the control system of the printing apparatus shown in FIG. 1.

FIG. 3 is a block diagram showing the main components of the ink-jet printing apparatus to which the present invention can be applied. Data to be printed such as the characters and the images are transmitted from a host apparatus 500 to the printing apparatus 100 and stored in a signal receiving buffer 104. Further, data for verifying whether the data has been transmitted properly and data for telling the operating condition of the printing apparatus 100 are transmitted to the host apparatus 500 from the printing apparatus 100.

The data stored in the signal receiving buffer 401 is processed into the data for carrying out the printing operation during the main scanning operation by the printing head 104 according to the control by a CPU 402 and is stored in a printing signal buffer portion in a random access memory (RAM) 403. The data stored in the printing signal buffer portion is transmitted to the printing head 104 by a printing head control portion 410 so that the printing head 104 is controlled for printing the characters or the images. Further, the printing head control portion 410 detects information concerning the condition of the printing head 104, such as the temperature thereof, for transmission to the CPU 402. On the basis of such information the CPU 402 controls the printing head 104 through the printing head control portion 410.

Further, the CPU 402 deducts used amounts of the inks, measured by the printing apparatus 100, from the remaining amounts of the inks read from the memory portions 110 of the ink tanks 30 and 40 respectively, so as to calculate new remaining amounts of inks in the ink tanks 30 and 40. And then, the CPU 402 writes the new remaining amounts of inks to the memory portions 110 at proper time. The amount of the used ink comprises the amount used during the printing operation of the printing apparatus and the amount discharged for the restoring operation of the printing head 104. The former amount can be measured by multiplying the number of ink dots to be formed on the printing medium 105, to be determined on the basis of the printing data of the image, by the amount of the ink ejected for the unit dot. On the other hand, the latter amount can be measured on the bases of the amount of the discharged ink for each restoring operation and the number of the times of the restoring operations.

According to the commands from the CPU 402, a mechanical control portion 404 drives and controls a mechanical portion 405, including a carriage motor for making a carriage 101 travel in the main scanning direction and a line feed motor for making the printing medium 105 travel in the sub-scanning direction. A sensor/SW control portion 406 transmits the signals, coming from a sensor/SW (switch) portion 407 comprising various sensors and switches, to the CPU 402. A display element control portion 408 controls a display portion 409, comprising the LED's of display panels and liquid crystal display elements, according to the commands from the CPU 407.

Figures 4A, 4B, 4C:
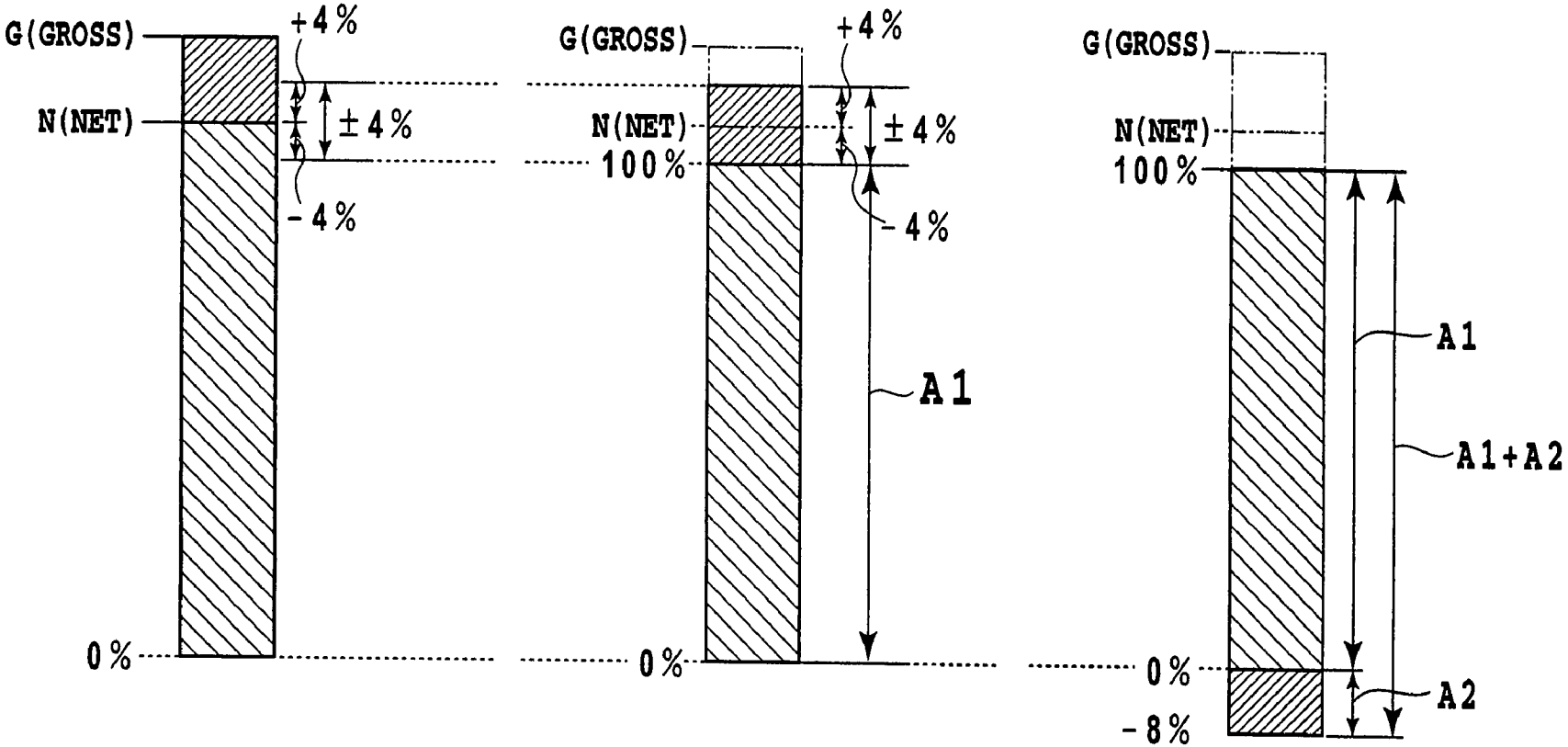
FIGS. 4A, 4B and 4C are the diagrams respectively illustrating the control ranges of the remaining amount of the ink according to the first embodiment of the present invention.

FIGS. 4A, 4B and 4C are the diagrams illustrating the conditions of the remaining amounts of the inks in the tanks 30 and 40, respectively.

In FIG. 4A, a term "gross" indicates the amount of the ink initially contained in the tank when the tank is manufactured (hereinafter referred to as "ink amount G"), while a term "net" indicates the usable amount of the ink out of the ink amount G (hereinafter referred to as "ink amount N"). The actually usable ink amount N is less than the ink amount G because some of the ink remains unused on the internal walls or the internal corners of the ink tank. It should be noted that the ink amount G varies within a certain extent owing to the variance in the amount of the filled ink occurring at the time of the manufacture of the ink tank. Such variance is hereinafter referred to as "manufacturing variance". Further, the amount of the ink remaining on the internal walls and corners of the ink tank varies depending on the individual tanks and the environmental conditions (e.g., the temperature) wherein the ink tank is used. Such variance is hereinafter referred to as "operating variance" of the ink tank. In consequence, the usable ink amount N varies within a certain variance range. In the case of the present embodiment, the variance in the usable ink amount N is assumed to be ±4%.

FIG. 4B illustrates a comparative example comparable with the present invention. In this comparative example, the normally useable amount of the ink in the tank, that is, the amount of the ink which is controlled by the printing apparatus 100 as being the usable amount A1 of the ink, is set to be 100% (hereinafter referred to as "standard ink amount"). And then, within a range of the standard ink amount A1, the information on the remaining amount of the ink is stored in the memory portion of the ink tank and is managed. The standard ink amount A1 is obtained by deducting the amount of the negative variance (i.e., 4% in this example) from the ink amount N. This standard ink amount A1 is stored as 100% of the remaining ink amount and is managed by the printing apparatus 100. Thus, when such a standard ink amount A1 is predetermined, the remaining amount of the ink (%) can be obtained by deducting the actually used amount of the ink from the standard ink amount A1.

By managing the remaining ink amount in this way, the occurrence of the situation such that the ink becomes unavailable despite that some ink is still remaining in the ink tank can be prevented. The standard ink amount A1 is set, on the basis of the ink amount N, as being the ink amount that is usable for carrying out the normal printing operation by the user. Actually, however, the ink amount N has the variance of ±4%. Therefore, in the case shown in FIG. 4B, if the tank whose ink amount N has the variance of +4% is used, there is the possibility that the printing apparatus 100 may determine that the remaining amount of the ink in the tank to be 0% despite that 8% of the ink is still remaining in the ink tank. If the printing apparatus 100 is controlled to discontinue its printing operation when the remaining amount of the ink in the ink tank is indicated to be 0%, 8% of the ink remaining in the ink tank can not used. If the printing apparatus 100 is designed to continue its printing operation even when the remaining amount of the ink in the tank is indicated to be less than 1%, it will be impossible for the printing apparatus to measure the actually used amount of the ink in the ink tank from that point on.

FIG. 4C shows the first embodiment of the present invention. In the case of the present embodiment, within a range of the amount of the ink comprising the standard ink amount A1 shown in FIG. 4B and an extra ink amount A2, the information on the remaining amount of the ink is stored in the memory portion 110 for being managed. The extra ink amount A2 is the amount of the ink to be controlled as a used amount of the ink where the printing apparatus 100 is operated by using more than the standard ink amount A1. In the case of the present embodiment, the extra ink amount A2 corresponds to the ink amount equivalent to 8%, that is, corresponds to the ink amount equivalent to the maximum variance of the ink amount N or ±4%. In other words, the remaining amount of the ink is calculated until the remaining amount of the ink in the ink tank shown in FIG. 4B becomes 0%, and the remaining amount of the ink is calculated until the amount of the ink equivalent to 8% (i.e., the maximum variance of the ink amount N or ±4%) is used up. That is, similarly to the case shown in FIG. 4B, in the case of the present embodiment, it is assumed that the standard ink amount A1 is defined to be 100% and that the ink is used gradually. In the case of the present embodiment, the ink is continuously used until even after the remaining amount of the ink in the ink tank has become 0%. More particularly, the used amount of the ink is continuously measured until the remaining amount of the ink reaches −8% to calculate the remaining amount of the ink to update the memory portion 110 accordingly. Thus, the amount of the ink used from the ink tank can be managed accurately. When the variance of ±4% is of the normal distribution, the amount of the ink in the ink tank can be considered to be zero where the remaining amount of the ink in the ink tank is −4% on the average.

In practice, however, 10%, a little larger than the maximum variance as being 8% of the ink amount N, is set as the extra ink amount A2. Thus, the standard ink amount A1, whose remaining amount is assumed to be 100% as in FIG. 4B, plus the extra ink amount A2, amounting to 110% in total, is assumed to be the amount of ink in the ink tank. And then, the used amount of the ink is measured to calculate the remaining amount of the ink. The remaining amount of the ink is stored in the memory portion 110. In consequence, the remaining amount of the ink in the ink tank is calculated within the range from 100% to −10% to be stored in the memory portion 110. The extra ink amount A2 is set to 10% for the necessity associating with the design problem although 8% is sufficient primarily for the extra ink amount A2 to be added to the standard ink amount A1 which is set to 100%. More particularly, the used amount of ink is measured within the range including the standard ink amount A1 and the ink amount (equivalent to extra ink amount) in consideration of at least the manufacturing variance and the operating variance of the ink amount (8%), so that it becomes possible for the user to manage the used amount of the ink more accurately.

In this way, the standard ink amount A1 plus the ink amount in consideration of the manufacturing variance/or the operating variance (i. e., the extra ink amount A2) is measured so that the remaining amount of the ink is calculated and stored in the memory portion 110. In other words, the information about the remaining amount of the ink in the ink tank can be stored in the memory portion 110 for managing within the range in which the remaining amount of the ink becomes 0% by using of the standard ink amount A1 and becomes −8% or −10% by further using of the ink.

In the present embodiment, the remaining amount of the ink by the percentage (%) is stored in the memory portion 110, assuming that the standard ink amount A1 is 100%. However, the present embodiment is not necessarily required to be on this assumption but the used amount of the ink may be stored in the memory portion 110. In short, the form of the information on the remaining amount of the ink or how to calculate the remaining amount of the ink does not matter as long as the information on the remaining amount of the ink can be properly stored.

The information on the remaining amount of the ink in the ink tank is inputted to the host apparatus 500 according to the command from the host apparatus 500 to be displayed on the monitor of the host apparatus 500. Hence, the host apparatus 500 constitutes a monitoring system for monitoring the used amount of the ink in the ink tank. For instance, the remaining amount of the ink is indicated as the levels ranging from the Level 4 to the Level −6.

Level 4: Remaining amount of the ink ranging from 100% to 80%

Level 3: Remaining amount of the ink ranging from 79% to 60%

Level 2: Remaining amount of the ink ranging from 59% to 40%

Level 1: Remaining amount of the ink ranging from 39% to 20%

Level 0: Remaining amount of the ink ranging from 19% to 0%

Level −1: Remaining amount of the ink ranging from −1% to −20%

Level −2: Remaining amount of the ink ranging from −21% to −40%

Level −3: Remaining amount of the ink ranging from −41% to −60%

Level −4: Remaining amount of the ink ranging from −61% to −80%

Level −5: Remaining amount of the ink ranging from −81% to −100%

Level −6: Remaining amount of the ink is −101% or less

Further, concerning the Bk tank 30, the level of the remaining amount of the Bk ink may be displayed; concerning the color ink tank 40, the level of the ink whose remaining amount is lowest among the C ink, Y ink and M ink may be displayed representatively.

The Second Embodiment

As for the printing apparatus 100, there can occur a control variance of the used amount of the ink resulting from the variance of the accuracy in measuring the used amount of the ink. The variance in measuring the used amount of the ink can comprise a variance occurring in counting the number of the ink dots ejecting from the printing head 104 and a variance occurring in accumulating the counted number of the ink dots. For instance, when the size of a single dot of the ink is assumed to be 9.4 ng despite actually being 9.5 ng, the variance in counting the number of the ink dots is effected. In this case, the variance results in the variance of about 1%. Further, the variance in accumulating the counts (of the ink dots) occurs, for instance, when determining the used amount of the ink based on the accumulated number of the ink dots formed by the ejected inks, that is, when the accumulated number of ink dots assumed to be 940,000 dots is actually 949,999 dots. In this case, the variance results in the variance of about 1%. Further, the latter variance (the variance in the accumulated number of the ink dots) can occur also when, for instance, the accumulated amount of used ink is rounded to four decimal places in determining the used amount to be stored in the memory portion 110 during the power source of the printing apparatus 100 is turned off. The number of the dots can be counted on the basis of the data of the image to be printed or the drive data of the printing head.

When such variances are found to occur further, the variance including such variances can be treated as the operating variance. Besides, it can be considered possible that the useable amount of the ink decreases gradually with the lapse of the time, but such variance can also be treated as the operating variance.

The Third Embodiment

Although not recommendable in view of the suppliers of the ink tanks, some of the users continue to use the cartridge type ink tank ignoring the indication that the remaining amount of the ink in the ink tank is "0" or by refilling the used-up ink tank with the ink obtained from a supplier other than the original supplier. Such practice by some of the users, however, can end up with the trouble of the printing apparatus or the printing head requiring some major repairs when such users desire to use such printing apparatus or the printing head further. In such a case, in carrying out the necessary troubleshooting for the printing apparatus or the printing head, the information stored in the memory portion of the ink tank is essential. As long as the ink in the ink tank is used for normal operation, the remaining amount of the ink is supposed to be within 100% to 0%.

Figures 5A, 5B, 5C:
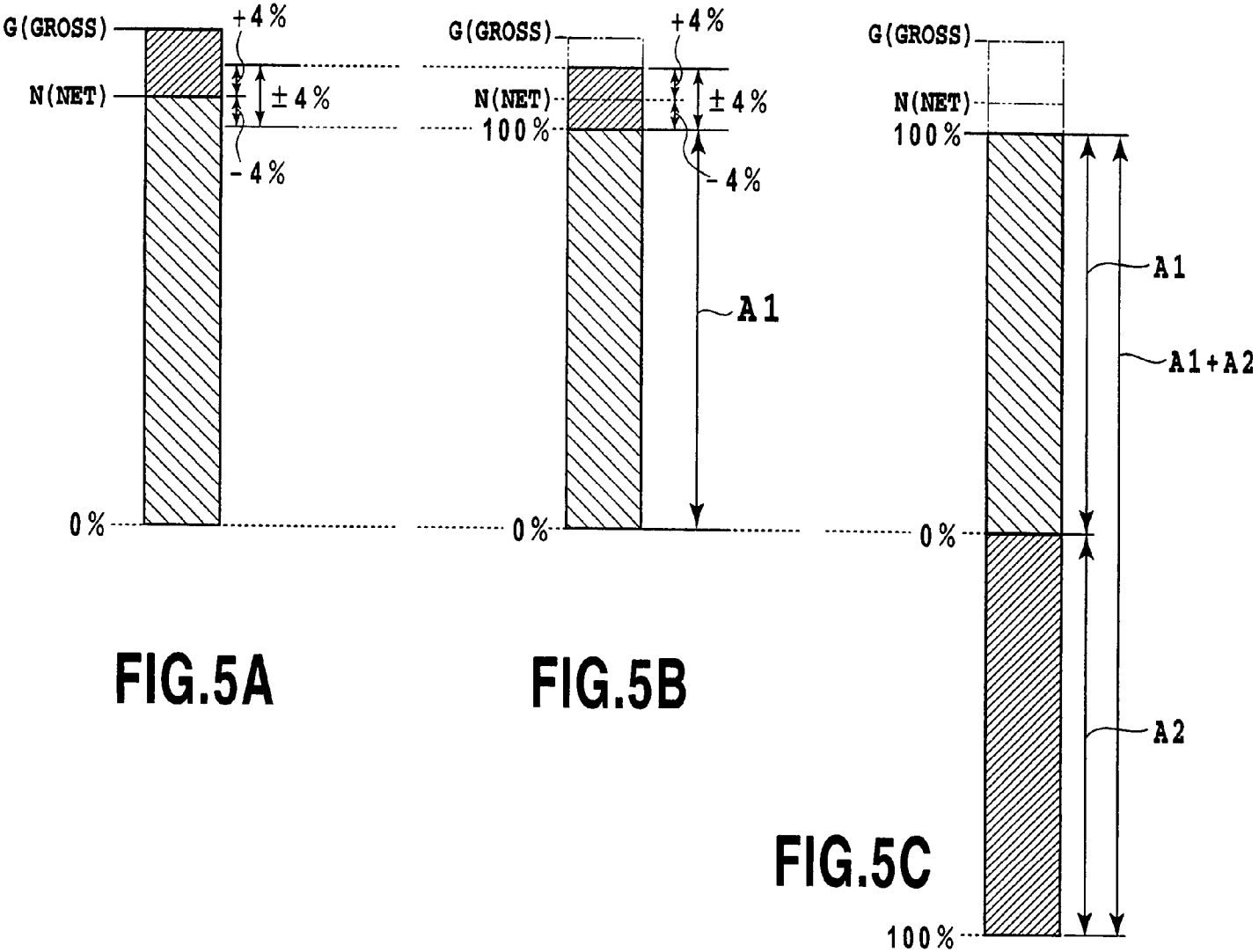
FIGS. 5A, 5B and 5C are the diagrams respectively illustrating the control ranges of the remaining amount of the ink according to the third embodiment of the present invention.

FIGS. 5A, 5B and 5C illustrate the case where the storable range of the remaining ink amounts in the memory portion 110 is doubled respectively compared with the previous applicable range. In this case, the information on the remaining amount of the ink is stored in memory portion 110 and is managed within a range including a range of 100% to 0% of the standard ink amount A1 and a range of 0% to −100% of the extra ink amount A2, as shown in FIG. 5C. When the printing apparatus 100 has become out of order, and the remaining amount of the ink is found to be −100%, it can be concluded that 2 times the standard ink amount A1 has been used. In such a case, there is the possibility that the printing operation has been continued despite that the remaining amount of the ink has become "0" or that the ink tank was refilled with the ink purchased from the supplier other than the original supplier, so that the repair work needs to be carried out in consideration of such possibility. Further, when the printing apparatus 100 is found out of order, the cause of the disorder needs to be analyzed by troubleshooting, and then the possible causes of the disorder need to be removed in the order of the magnitude thereof for the restoration of the normal state. In the worst case, it can happen that the printing head or the printing apparatus is found to be unusable.

Thus, the information on the remaining amount of the ink stored in the memory portion 110 can be utilized effectively as one of the various kinds of information useful in taking prompt action if the printing apparatus 100 gets out of order. More particularly, the used amount of the ink larger than the standard ink amount A1 is measured so that the measured used amount of the ink or the remaining amount of the ink calculated on the basis the measured used amount of the ink is stored in the memory portion 110. As a result, the information stored in the memory portion 110 can be utilized effectively.

Theoretically, it is desirable that information on an amount of the ink infinitely larger than the standard ink amount A1 can be stored in the memory portion 110, but the memory having such a capacity is unnecessary because of both the cost and the practical use thereof. Therefore, it seems reasonable to set the extra ink amount A2 in consideration of a range in which the printing head can be operated without getting out of order, even when the printing operation is continued in the condition that the ink in the ink tank is almost used up (hereinafter referred to as "no-ink printing operation"). It is preferred that the extra ink amount A2 is set to be at least an amount to be needed for the no-ink printing operation. In other words, first it is necessary to examine the length of the printing when executing the no-ink printing operation, and then it is necessary to determine the extra ink amount A2 required to execute the no-ink printing operation so that the information on the amount of the ink is stored in the memory portion 110 and is managed within the range including the standard ink amount A1 and the extra ink amount A2.

For example, a specified amount of the no-ink printing operation is carried out (the first printing operation); subsequently, a specified amount of a printing operation, with the ink being supplied normally, is carried out (the second printing operation); the first printing operation and the second printing operation are repeated several times respectively to examine whether there occurs any trouble in the printing head. More specifically, a printing amount by the second printing operation is specified, for example, as being a printing amount requiring the uniformly printing all over the printing areas of 6 pages of the A4 size sheet; a printing amount by the first printing operation (actually, no image will be printed, since the printing operation is no-ink printing operation) is made variable as a parameter; such first printing operation and the second printing operation are repeated 20 times respectively to examine whether or not any abnormal condition has occurred in the printing head. For instance, in the case of one printing head, no abnormal condition has occurred during the first printing operation, when the printing amount is set to the level requiring the use of 5% of the standard ink amount A1, while the abnormal condition has occurred when the printing amount by the first printing operation is raised. In this case, the used amount of the ink was measured within a range of the remaining amount of the ink in the ink tank including a range from 100% to 0% (i.e., standard ink amount A1) and a range from 0% to −100% (i.e., −5%×20 times; extra ink amount A2), and the used amounts of the ink and the remaining amounts of the ink, calculated on the basis of the used amount of the ink, are stored in the memory portion 110 for control.

The Fourth Embodiment

The number of the tanks, used with the printing head and wherein the remaining amounts of the inks are −10% or less, are counted, and the counted number of tanks may be stored to the memory portion 110 or the printing apparatus 100. In other words, out of the tanks replaceably mounted with the printing head, the number of tanks whose remaining amounts of the inks have become −10% or less is counted and stored. In the case of the third embodiment, the used amount of the ink for each tank is measured within the range larger than the standard ink amount A1 so that the used amount of the ink or the remaining amount of the ink, calculated based on the used amount of the ink, is stored for being managed. In the case of the present embodiment, the number of tanks, wherein the ink is used exceeding the standard ink amount A1, is counted and stored corresponding to each printing head or each printing apparatus, so that the condition under which the printing apparatus or the printing head has been used can be analogically estimated. If some kind of trouble occur to the-printing apparatus or the printing, such count number can be utilized effectively for analyzing the cause of the trouble.

For example, when the repair of the printing apparatus has become necessary owing to the trouble thereof, and it is found that the trouble is caused by that the ink has been used exceeding the standard ink amount A1 with respect to 12 tanks, such trouble can be presumed to have been caused by that the printing operation has been continued with the empty tanks or with the tanks refilled with the non-standard inks. In this case, the attention during the repairing work of the printing head can be paid to the printing head or a maintenance portion of the printing apparatus. Thus, by measuring the amount of the ink remaining in the ink tank indicating the use of the ink exceeding the normal amount to be used (e.g., the case of the third embodiment) or by counting the number of tanks wherein the remaining amounts of the inks used are larger than the normal amounts of the use (e.g., the case of the fourth embodiment), the prompt action for the repair can be taken when the trouble of the printing apparatus is found.

The Fifth Embodiment

In the case of the ink tank containing a plurality of the inks of different colors, such as the color tank 30, the information about the remaining amounts of the inks of different colors are stored in the memory portion so that the printing apparatus can be allowed to pay attention to the tank containing the smallest remaining amount of the ink for control. Further, in the case of the ink tank containing only one color ink, such as the Bk tank 30, it is sufficient for the control of the ink tank to pay attention only to the remaining amount of the ink in the ink tank. Further, where a plurality of tanks containing the inks of different colors respectively, it is sufficient to pay attention to the remaining amount of the ink in each of the ink tanks for control. Hence, the present invention is applicable to either an ink tank containing the inks of different colors or an ink tank containing only an ink of any one color.

Other Embodiments

The ink tank may take either a type separable from the printing head or a type integrally formed with the printing head. Further, the ink may be either a liquid ink for the ink-jet printing system or the powdered solid ink applicable to the printing system using the toner.

Further, the ink tank may carry identification information to differentiate it from the other so that the printing apparatus distinguishes the identification information to understand the ink tank used in the past and the ink tank in use in addition to obtaining information on whether the ink tank has ever been replaced. Besides, with respect to a specific ink tank, the number of times of the mounting with and the dismounting from the printing apparatus can be stored by using such identification information whereby servicing information can be provided to users at the time when any trouble has occurred in the printing apparatus, the printing head or the ink tank.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2003-286974 filed Aug. 5, 2003, which is hereby incorporated by reference herein.

What is claimed is:

1. An ink tank, for containing an ink to be supplied to a printing apparatus, comprising storing means for storing information concerning a remaining amount of the ink, wherein said storing means stores the information concerning the remaining amount of the ink including a range of an amount of the ink including a standard amount of the ink and an extra amount of the ink, information on the standard amount of the ink is used by the printing apparatus as information on a usable amount of the ink, the standard amount of the ink at a start of an initial use of the ink tank corresponding to a total predetermined usable amount of the ink contained in the ink tank at an initial state of the ink tank, information on the extra amount of the ink is used by the printing apparatus as information on an amount of the ink corresponding to an amount of the ink to be used by the printing apparatus when an operation for using an excess amount of the ink over the standard amount of the ink is executed by the printing apparatus, the extra amount of the ink being larger than an amount corresponding to a maximum variance in the usable amount of the ink, the information on the extra amount of the ink is updated according to an amount of the ink used by the printing apparatus after the standard amount of the ink at the start of the initial use of the ink tank is used, and wherein the information concerning the remaining amount of the ink includes information about a remainder obtainable by deducting an amount of the ink to be used for operation of the printing apparatus using the ink from the sum of the standard amount of the ink and the extra amount of the ink.

* * * * *